US011111737B2

(12) United States Patent
Radtke et al.

(10) Patent No.: US 11,111,737 B2
(45) Date of Patent: Sep. 7, 2021

(54) DOWNHOLE COUPLING MECHANISM

(71) Applicant: Morphpackers US, The Woodlands, TX (US)

(72) Inventors: Cameron Radtke, Aberdeen (GB); Philip Turrell, Aberdeen (GB); Christopher Cockrill, Aberdeen (GB)

(73) Assignee: MORPHPACKERS LIMITED, Aberdeen (GB)

( * ) Notice: Subject to any disclaimer, the term of this patent is extended or adjusted under 35 U.S.C. 154(b) by 0 days.

(21) Appl. No.: 16/589,496

(22) Filed: Oct. 1, 2019

(65) Prior Publication Data

US 2021/0095530 A1 Apr. 1, 2021

(51) Int. Cl.
*E21B 17/046* (2006.01)

(52) U.S. Cl.
CPC ..... *E21B 17/046* (2013.01)

(58) Field of Classification Search
CPC ..... E21B 17/046
USPC ..... 166/242.6
See application file for complete search history.

(56) References Cited

U.S. PATENT DOCUMENTS

| | | | | |
|---|---|---|---|---|
| 7,318 | A * | 4/1850 | Brown | E21B 17/046 285/396 |
| 4,659,119 | A | 4/1987 | Reimert | |
| 4,697,947 | A | 10/1987 | Bauer et al. | |
| 5,950,744 | A | 9/1999 | Hughes | |
| 9,845,645 | B2 | 12/2017 | Hughes et al. | |
| 10,060,197 | B2 | 8/2018 | Hughes et al. | |
| 10,066,446 | B2 | 9/2018 | Hughes et al. | |
| 2008/0230218 | A1 | 9/2008 | Hall et al. | |
| 2018/0313179 | A1 * | 11/2018 | Kandaswami | E21B 43/10 |

FOREIGN PATENT DOCUMENTS

| | | | |
|---|---|---|---|
| DE | 2310375 | 3/1973 | |
| GB | 2276217 A * | 9/1994 | E21B 17/08 |
| GB | 2573143 A | 10/2019 | |

OTHER PUBLICATIONS

Combined Search and Examination Report under Sections 17 & 18(3) from related Application No. GB1806818.9. dated Sep. 28, 2018. 6 Pages.

* cited by examiner

*Primary Examiner* — Taras P Bemko
(74) *Attorney, Agent, or Firm* — FisherBroyles, LLP; Craig W. Mueller

(57) ABSTRACT

A downhole coupling mechanism for use in downhole tools that find application in wells exploited by a hydraulic refracturing process. The downhole coupling mechanism connects first and second tubular sections via a tensile load arrangement of wires located in complimentary grooves, a torque arrangement of interlocking lugs and notches on opposite ends, and a seal arrangement. The downhole coupling mechanism provides a thin walled coupling where a screw-threaded connection could not achieve the required tensile load, torque and sealing properties needed. Embodiments of a thin walled anchor and packer including the downhole coupling mechanism are described.

22 Claims, 4 Drawing Sheets

Detail A

DOWNHOLE COUPLING MECHANISM

FIELD OF THE DISCLOSURE

The disclosure relates to a downhole coupling mechanism for a tubular assembly for use in oil and gas wells. Particularly, a downhole coupling mechanism in an anchor and morphable packer for use in wells exploited by a hydraulic refracturing process is described.

BACKGROUND

Hydraulic fracturing, or fracking, is a technique for cracking rock by the injection of a mixture of sand and fluid under pressure. This technique enables extraction of oil or gas contained in highly compact and impermeable rocks.

The wellbores for fracking are drilled down to a depth at which rock layers with hydrocarbon deposits can be found. The wellbores are then drilled horizontally along the rock layer. Hydraulic fracturing of the horizontal wellbores is usually conducted in multiple stages with fractures created in the surrounding rock at specific points along the wellbore.

Two methods of hydraulic fracturing are most commonly used. One of the most common techniques requires the well to have a cemented casing and involves a plug and perforate technique whereby cement plugs are created to isolate specific sections within the well; each section is then perforated and fractured. The plugs are then drilled, and the production stage of the operation is begun.

Another common technique uses a non-cemented casing arrangement where sliding sleeves and packers are provided around the outer circumference of the casing string. Once the casing string is inserted into the well, the packers are expanded to secure the string in position and isolate sections of the well to be fracked. The sleeves are then shifted to an open position by the pumping of specifically sized balls into the well. When a sleeve is actuated under the action of a ball, fracturing ports are opened, and the isolated zone is fractured and stimulated by fluid diverted through the open fracturing ports. The production stage of the operation can then begin.

After a few years in operation, the gas or oil production level of a well may decrease. Following the initial production period, it is common to stimulate the well by refracturing. Refracturing aims to either increase the depth of the original fractures or to develop a new network of fractures from which gas or oil may be extracted from rock. Refracturing often restores well productivity to close to original levels and thus extends the lifespan of the well.

Refracturing is performed in an existing wellbore and is thus advantageous because it does not require the steps of drilling and completing a well bore. The process of refracturing an existing well is therefore often significantly less costly and more economical than drilling a new well.

In wells having a cemented casing, refracturing can be performed by installing and cementing a new casing having a smaller diameter than the original casing before a "plug and perforation" method of fracturing is used. It is important that the cement layer between the two casings provides a high quality seal in order for the process to be effective. In addition, the perforating step conducted during the refracturing process must go through two casing walls. Alternatively, a new casing, or tubular conduit, provided with an expandable metallic tubular sleeve, or packer, may be provided where the sleeve is designed to expand within the original casing of the well with a plug and perforation technique subsequently employed again.

With each of these refracturing techniques, the newly provided casing has a reduced internal diameter compared to the initial internal diameter of the well casing. Generally, efforts are made to maximize the diameter of the new casing by reducing tolerances between the new casing and existing casing to as small as possible. This creates a need for packers that are thin-walled and are designed to maintain the greatest inner diameter possible while still achieving sufficient gripping and sealing capability on the existing casing.

A limitation on such thin-walled arrangements is found in forming threaded couplings between the components. Such couplings are necessary in order to maintain a seal, provide sufficient tensile loading and meet torque ratings. Premium (sealing) threads are not available in the required sizes, and the wall is not thick enough to cut a normal ACME or Stub ACME thread. Additionally, these screw threaded couplings do not handle radial loads well.

Gladstone, GB 2,267,217 discloses a connector with a dowel device for application in boring holes for mining or exploration. The device of Gladstone features grooves for interlocking sections, but the device is not applicable to refracturing. There is a rotary-drill casing connector having interconnecting male and female sleeves incorporating lugs and sockets around the periphery for the purpose of transmitting rotary motion and providing segmental abutment faces for supporting axial compressive loads. The two sleeves are held together by means of a flexible multi-stranded steel wire rope dowel that is inserted manually from the outside via an aperture into a circular annular cavity, half of which is formed on the inside face of the female sleeve and half formed on the outer face of the male sleeve. The connection is sealed against leakage or ingress of fluids by a pliable sealing 'O' ring contained in a groove formed in the sleeve such that the seal is compressed when the parts are connected together.

Reimert, U.S. Pat. No. 4,659,119 discloses a connector assembly including a pin connector for receipt by a box connector. An external surface of the pin features a helical groove, a generally complementary internal surface of the box features a helical groove of the same rotational sense and pitch. A helical latch coil is carried in one of the grooves, extending partly out of the groove. The connectors are latched together by stabbing the pin into the box so that the latch coil is ratcheted into place, partly extending into the groove of the connector not carrying the coil. Subsequent mutual rotation between the connectors in one rotational sense tightens the latched connection and rotation in the opposite sense releases the latching. The connector functions without the need for substantial rotation or torque.

Bauer et al., U.S. Pat. No. 4,697,947 discloses a plug connection for drilling or boring tubes, rods and worms for earth boring equipment with a male part and a female part, with a radial coupling for torque transfer and with an axial coupling having in the overlap zone of the male and female parts, and a locking device that can be introduced into an annulus for transferring axial forces. The locking device is constructed as a multilink chain that essentially extends around the entire annulus and is introduced through the female part into the annulus via a single opening.

Lehmann, DE 2310375 discloses a detachable pipe end connection for locking opposing pipe ends with different joint designs and engageable gearing featuring a retractable overrunning pipe end rotatably fixed and centered, and both of an inserted flexible locking cord in one of two mutually opposite half-grooves in a cavity. The entire tube circumference outside the coupling region is blocked and secures and features a flexible locking cord. For insertion or removal of the flexible locking cord, window-like openings are provided.

It would be desirable to provide a coupling mechanism for securing tubular sections together in a wellbore over a thin-wall. It would also be desirable to provide a coupling mechanism for securing tubular sections that overcomes at least some of the disadvantages of the prior art.

SUMMARY

In a first aspect the present disclosure relates to a downhole coupling mechanism between a first end of a first tubular section being part of a downhole tool and a second end of a second tubular section;

each end including one or more complimentary circumferential grooves machined in opposing surfaces to align when the first and second ends are arranged co-axially one inside the other;

one or more wires, each wire being located within one of the circumferential grooves on the first end and a complimentary one of the circumferential grooves on the second end, so that each pair of complimentary grooves contains one wire extending around the circumference of the surface of each end;

at least one lug and notch arranged on opposite of the first and second ends providing interlocking engagement when the first and second ends are arranged co-axially one inside the other; and a seal arranged between the opposing surfaces when the first and second ends are arranged co-axially one inside the other.

The downhole coupling mechanism provides a tensile loading through the wires, a torque rating via the interlocking lug and notch, and a seal between the tubular sections without incorporating a screw-threaded connection.

Preferably, the wall thickness of the downhole coupling mechanism when the first and second ends are arranged co-axially one inside the other is less than or equal to about 5%, 10%, 15% or 20% or so of the outer diameter of the downhole coupling mechanism. More preferably, the wall thickness of the downhole coupling mechanism when the first and second ends are arranged co-axially one inside the other is less than or equal to about 8%, 10%, 12%, 14%, 16%, 18% or 20% or so of the inner diameter of the downhole coupling mechanism. This provides a thin-wall tubular connection. In some instances, the inner diameter at the coupling mechanism is greater than or equal to about 3.00", 3.20", 3.40", 3.50", 3.60", 3.70", 3.80", 3.90", 4.00", 4.10", 4.20", 4.40", 4.60" or so, and the outer diameter at the coupling mechanism is less than or equal to about 4.00", 4.10", 4.20", 4.40", 4.50", 4.60", 4.70" 4.80", 4.90", 5.00", 5.10", 5.20", 5.40" or so. In a preferred embodiment the inner diameter at the coupling mechanism is greater than or equal to 3.843" (97.61 mm) and the outer diameter at the coupling mechanism is less than or equal to 4.700" (118.44 mm). The inner diameter provides the clearance through the bore of the downhole tool.

Preferably, the seal is arranged in a seating groove that is circumferential and continuous around an outer surface. In this way, an o-ring seal may be used that is restricted in longitudinal movement in the coupling mechanism. Providing a groove to seat the seal in also allows use of a thicker seal. Preferably there are two seals arranged adjacent to each other on the coupling mechanism.

Preferably there are two lugs and notches opposite of the first and second ends. More preferably the lug and notch are arranged equidistant around the outer surface. More preferably a length of the lug that is co-axial with a central axis of the tubular sections is greater than the wall thickness of the downhole coupling mechanism. This provides an increased torque rating over a screw thread connection of similar thickness.

Preferably, a plurality of complimentary circumferential grooves are provided on opposing surfaces, with each complimentary pair of grooves containing a wire. Alternatively, there may be a single groove provided helically around the surface substantially like a screw thread having a complimentary screw thread in the opposing surface. In this arrangement there may be a single wire wound helically along the connection. Preferably, there are more than three or four or five or six pairs of complimentary circumferential grooves. More preferably, there are more than eight or nine or ten pairs of complimentary circumferential grooves. There may be more than eleven or twelve pairs of complimentary circumferential grooves. In a preferred embodiment there are fifteen pairs of complimentary circumferential grooves with fifteen wires. The increased number of wires increases the tensile loading of the coupling. Preferably, the wires are continuous loops. The wires may be of circular, square, rectangular or custom engineered cross-section. More preferably each wire has a diameter in cross-section greater than a depth of a groove into which they locate. This provides the required tensile loading through the coupling mechanism.

Preferably, the downhole tool is a packer. Alternatively, the downhole tool may be a liner hanger. Optionally, the downhole tool may be an anchor. Preferably, the downhole coupling mechanism is at a lower end of the downhole tool to connect the tool to a tubular string located deeper in a well. This may be considered as a run-in configuration.

Preferably, the downhole tool includes a plurality of slips arranged on a wedge formed in a body of the tool, the slips being movable radially outwards by the action of a piston moved longitudinal in a first direction where the slips are held against the body by at least one retainer band prior to movement by the piston. Preferably. the retainer band is a wire. More preferably, the slips may be held in place against the body with a combination of a retainer wire and screws or pins. By having slips directly located against the tool body and the slips retained by a wire, this anchoring arrangement for use in anchors, packers and liner hangers may be thin-walled.

Preferably, a wall thickness of the downhole tool prior to actuating the slips is less than or equal to about 5%, 10%, 15% or 20% of the outer diameter of the downhole tool prior to actuating the slips. More preferably, a wall thickness of the downhole tool prior to actuating the slips is less than or equal to about 8%, 10%, 12%, 14%, 16%, 18% or 20% of the inner diameter of the downhole tool prior to actuating the slips. This provides a thin-wall tubular connection. In some instances, the inner diameter at the coupling mechanism is greater than or equal to about 3.00", 3.20", 3.40", 3.50", 3.60", 3.70", 3.80", 3.90", 4.00", 4.10", 4.20", 4.40", 4.60" or so, and the outer diameter at the coupling mechanism is less than or equal to about 4.00", 4.10", 4.20", 4.40", 4.50", 4.60", 4.70" 4.80", 4.90", 5.00", 5.10", 5.20", 5.40" or so. In a preferred embodiment the inner diameter at the coupling mechanism is greater than or equal to 3.843" (97.61 mm) and the outer diameter at the coupling mechanism is less than or equal to 4.700" (118.44 mm). The inner diameter provides the clearance through the bore of the downhole tool. The outer diameter determines the borehole size or installed casing/liner size through which the downhole tool can be run-in.

Preferably, the downhole tool features a ratchet arranged to prevent movement of the slips in a second direction, opposite the first direction. In this way, a ratchet provides a thin mechanism to hold the slips in the radially extended position. Preferably the downhole tool also includes a piston lock to prevent movement of the piston until actuation of the slips is required. Preferably the piston is arranged below the slips in a run-in configuration. In this way, premature actuation of the slips during run-in is avoided. Preferably, the piston lock features a sleeve moveable under pressure to release a collet arranged on the piston. As hydraulic force is used, the lock mechanism can be kept thin-walled. Preferably, the piston lock sleeve is moved in the second direction under fluid pressure pumped from surface through the bore of the downhole tool. More preferably, the piston is moved to actuate the slips by continual pumping of fluid through the bore of the downhole tool.

Preferably, the downhole tool includes a morphable element. The morphable element may be considered as a packer element. More preferably, the morphable element is a sleeve arranged on the tool body, sealed thereto and providing an annular chamber, that when fluid is introduced to the chamber, expands the sleeve to seal against a borehole wall or a tubular in which the packer element is located. The borehole wall or tubular, which may be casing, liner or similar may be considered as an outer substantially cylindrical structure. Preferably, the morphable element is above the slips in the run-in configuration. More preferably, the piston lock is released, and the piston moves at a fluid pressure above a setting pressure for the morphable element. In some instances, the morphable element is metal and the setting pressure morphs the sleeve against the outer substantially cylindrical structure. In this way, pressure does not have to be held in the bore when the anchor mechanism and the morphable element are set.

DETAILED DESCRIPTION

In the description that follows, it is understood that the drawings are not necessarily to scale. Certain features of the downhole coupling mechanism for a tubular assembly for use in oil and gas wells as described herein may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. All numerical values in this disclosure are understood as being modified by "about." All singular forms of elements, or any other components described herein including without limitations components of the apparatus are understood to include plural forms thereof. The downhole coupling mechanism for a tubular assembly for use in oil and gas wells will now be described with reference to the following figures, by way of example only.

Figure 1:
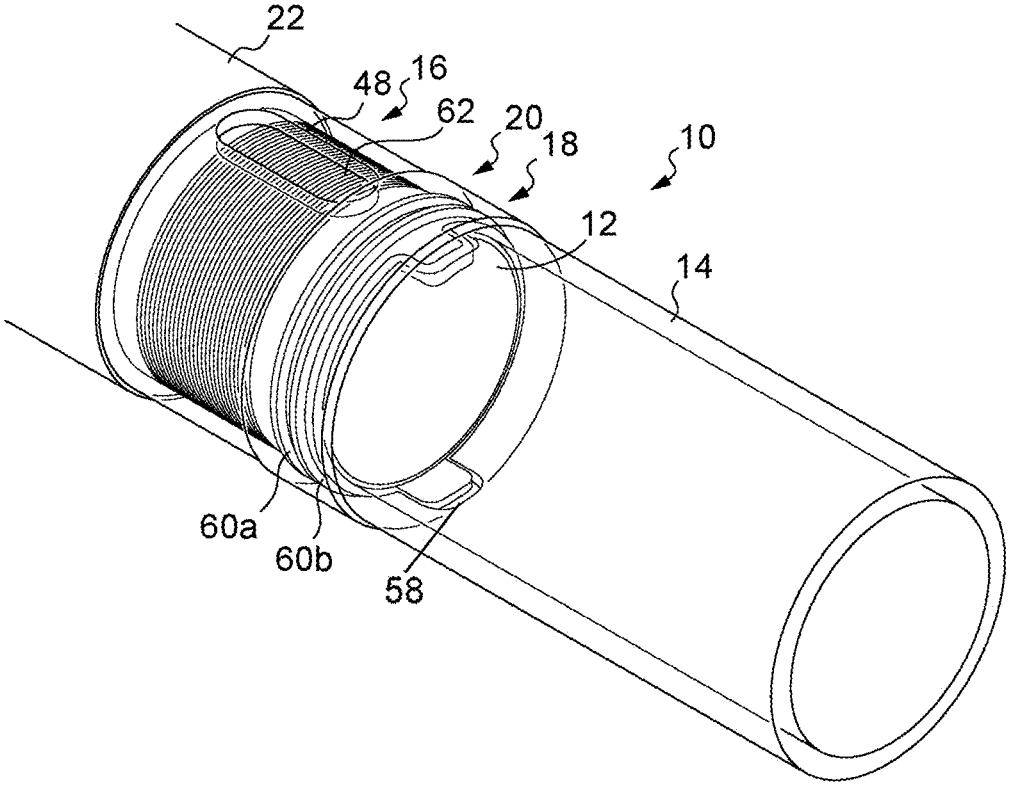
FIG. 1 is a schematic plan view of a downhole coupling mechanism as described herein.

Referring to FIG. 1, the drawings illustrate a downhole coupling mechanism, generally indicated by reference numeral 10 as described herein. Coupling mechanism 10 features a first tubular section 12 and a second tubular section 14 connected via a tensile load arrangement 16, a torque arrangement 18 and a seal arrangement 20. Arrangements 16, 18, 20 allow the tubular sections 12, 14 to be fixed together without a screw threaded connection and can thus find application in small diameter bores and casing strings used downhole.

Figure 2A:
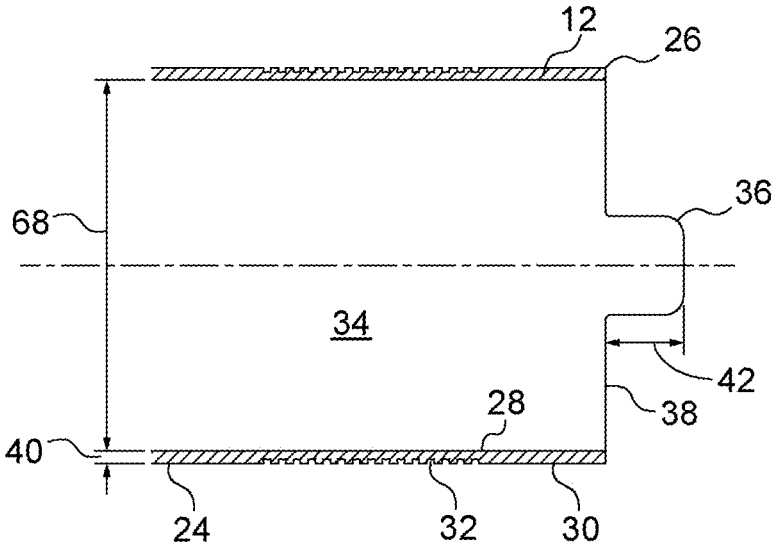
FIG. 2A is a cross-sectional view through a first tubular section of the downhole coupling mechanism of FIG. 1.

The first tubular section 12 is considered as an end piece to a downhole tool 22. The downhole tool 22 may be an anchor, packer, liner hanger or similar tool used within a wellbore. FIG. 2A illustrates a tubular member 24 forming a portion of a downhole tool 22 and having a first tubular section 12 at a first end 26 thereof. Tubular section 12 has a smooth circumferential inner surface 28. The outer surface 30 is provided with a series of grooves 32. Each groove 32 is preferentially square in cross-section though may be of any cross-sectional shape such as circular, v-grooved, dovetailed or a hooked profile. Each groove 32 is provided into the outer surface 30 to provide a continuous groove depth around a circumference of the outer surface 30. There are a number of grooves 32. In a preferred embodiment, there are fifteen grooves but there may be any number ranging typically from 3 to 20. A greater number is preferred. The series of parallel grooves 32 are perpendicular to the bore 34 through the tool 22 and provide a continuous circumferential profile on the outer surface 30. The shape is entirely circumferential in that, a cross-sectional view as shown in FIG. 2A, would be identical for every cross-section around the tubular section 12. This is in contrast to a screw thread arrangement that would provide a single groove helically wound on the outer surface. A single wire may be fed around such a helical groove.

The first tubular section 12 also features lugs 36. Lugs 36 are protrusions or tongues extending from the end face 38 of the section 12. These are best seen with the aid of FIG. 1. In a preferred embodiment, two lugs 36 arranged equidistant around the end face 38 are provided. However, there may be any number of lugs 36. Each lug 36 is preferentially square in cross-section with rounded edges to assist in assembly. Each lug 36 is of the same thickness as the wall thickness 40 of the section 12 so that the inner 28 and outer surfaces 30 extend over the lugs. A protrusion length 42, coaxial with the bore 34, is also greater than the wall thickness 40.

Figure 2B:
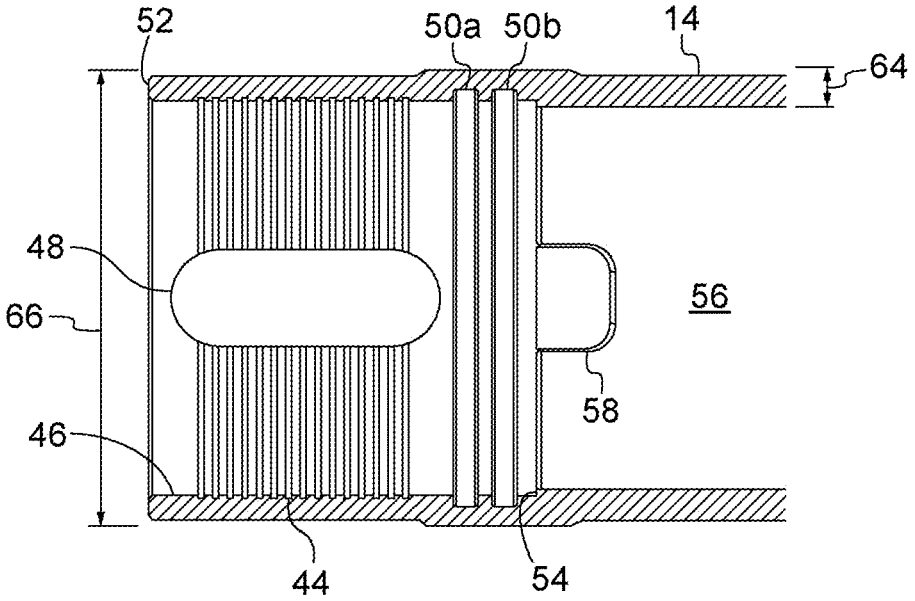
FIG. 2B is a cross-sectional view through a second tubular section of the downhole coupling mechanism of FIG. 1.

FIG. 2B illustrates the second tubular section 14 being the complimentary mating section to the first tubular section 12. The second tubular section 14 also has a cylindrical body and a series of grooves 44. Grooves 44 match the grooves 32 in number, depth, and position along the section 14, but are now arranged on the inner surface 46. A longitudinally arranged access window 48 is machined through the section 14 over the grooves 44.

Adjacent to the grooves 44 are two further grooves 50*a*, 50*b*. The further grooves 50*a*, 50*b* are wider and deeper than the grooves 44, but they are also continuous around the inner surface 46 and are neither helical nor provide a thread. Though two further grooves 50*a*, 50*b* are shown there may be a single further groove or more than two further grooves, but there will always be fewer further grooves 50 than grooves 44.

When considered from an end face 52 of the second tubular section 14, there are the grooves 44, the further grooves 50 and then a stop edge 54. Stop edge 54 is provided by a reduction in the inner diameter of the tubular section 14 providing a circumferential rim or lip arranged perpendicular to the bore 56. The stop edge 54 has a width greater than or equal to the wall thickness 40 of the first tubular section 12. Machined into the stop edge 54 is a notch 58 that does not extend through the wall thickness. There are two notches 58 preferably equidistantly machined around the edge 54, the number and dimensions of each notch 58 match the lugs 36 on the first tubular section 12. The second tubular section 14 may form part of tubing such as casing or liner. The second tubular section 14 may be considered as a bottom sub for connection to other downhole tools and components.

Returning to FIG. 1, the coupling mechanism 10 is illustrated in an assembled form. The second tubular section 14 has been slid over the first tubular section 12 until the end face 38 has abutted the stop edge 54. The sections 12 and 14 have been aligned so that the lugs 36 fit in the notches 58. Prior to engagement, seals 60*a*, 60*b* have been located in the further grooves 50*a*, 50*b*. Upon engagement, grooves 44 will be coaxial with grooves 32. Separate wires 62 are each located in one of the groove pairs 32,44 and joined to provide individual wire loops in each groove 44 via the access window 48.

The grooves 32,44 with corresponding wires 62 provide the tensile load arrangement 16. In a preferred embodiment there are fifteen grooves 32, 44 with corresponding wires 62. However, preferably there are more than three wires. More preferably, there are more than eight wires. There may be more than eleven wires. The increased number of wires increases the tensile loading of the coupling 10. The wires 62 are preferentially of square cross-section and may be considered as a square locking wire. Wire having a circular, triangular, rectangular or other cross-sections may also be used. Each wire 62 has a diameter in cross-section, perpendicular to the axis of the bores 34, 56, greater than a depth of a groove 32, 44 into which they locate. This ensures that the wires 62 lie between the first and second tubular sections 12, 14. In the embodiment shown, the wires 62 are sized to fill both grooves 32,44 so as to prevent relative longitudinal movement of the tubular sections 12,14. This provides the required tensile loading through the coupling mechanism 10.

The seals 60*a*, 60*b*, within the further grooves 50*a*, 50*b*, that are sized to protrude from the further grooves 50*a*, 50*b* and be compressed against the outer surface 30 of the first tubular section 12 provides the seal arrangement 20. The seal arrangement 20 prevents the egress of fluid through the coupling mechanism 10.

The combination of the lugs 36 and notches 58 provide the torque arrangement 18. The length 42 of the lugs 36 provides abutting surfaces between the lugs 36 and notches 58 that are parallel with the axis of the bores 34, 56. As this length 42 is greater than a wall thickness 64 of the coupling mechanism 10, this gives a torque rating to the coupling mechanism 10 greater than the torque rating of a screw threaded connection of similar thickness.

The tensile load arrangement 16, torque arrangement 18 and seal arrangement 20 of the coupling mechanism 10 can all be formed over relatively small wall thicknesses. The coupling mechanism 10 is suitable for slim hole arrangements where a maximum bore 34, 56 is required to be maintained. The wall thickness 64 of the made-up coupling mechanism 10 is less than or equal to 10% of the outer diameter 66 of the coupling mechanism 10. Also, the wall thickness 64 is less than or equal to 12% of the inner diameter 68 of the coupling mechanism 10. This provides a thin-wall tubular connection. In a preferred embodiment, the inner diameter 68 is greater than or equal to 3.843" (97.61 mm) and the outer diameter 66 is less than or equal to 4.700" (118.44 mm). The inner diameter 68 provides clearance through the bore 34, 56 of the downhole tool 22.

By providing such a small relative wall thickness over the tubing diameter, the coupling mechanism 10 finds use on downhole tools used in refracturing operations such as anchors, liner hangers and packers and provides particular advantages. An embodiment of a suitable anchor 70 with the coupling mechanism 10 is now described with reference to FIGS. 3A, 3B, 4A and 4B.

Figure 3A:
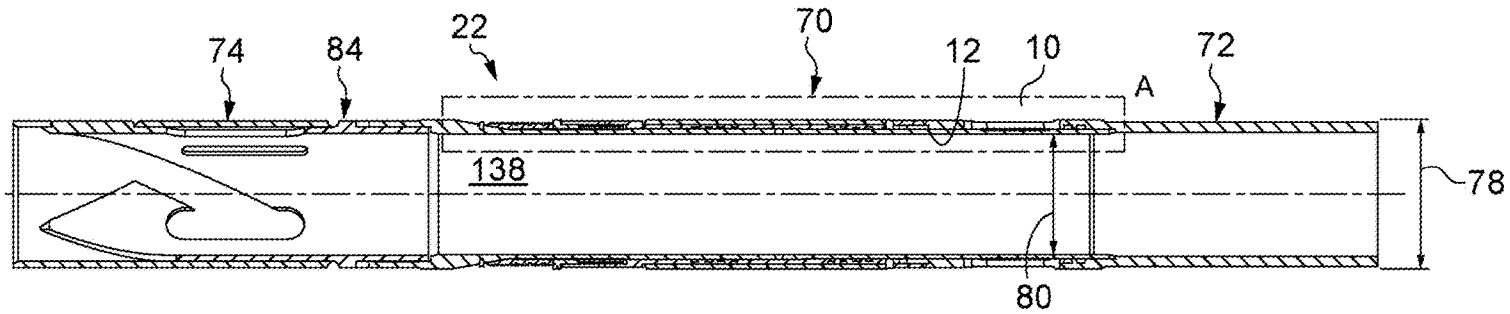
FIG. 3A is a cross-sectional view through an anchor including the downhole coupling mechanism of FIG. 1.
Figure 3B:
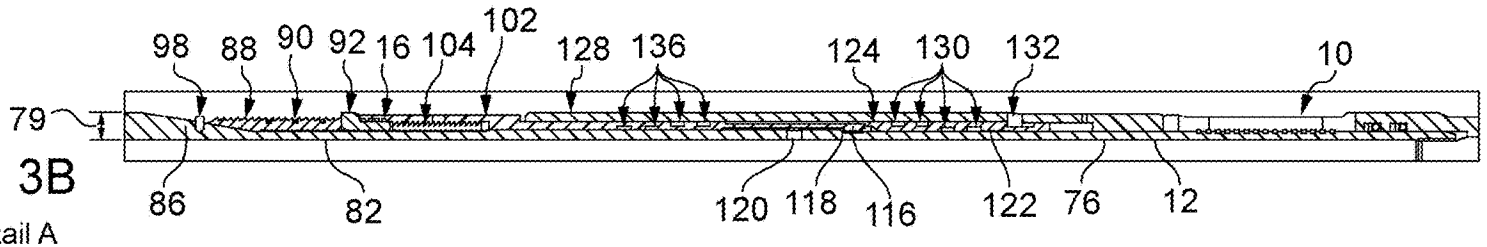
FIG. 3B is an exploded view of section A of FIG. 3A.

FIG. 3A is a cross-section view of a downhole tool 22 being an anchor 70 incorporating the coupling mechanism 10 according to an embodiment described herein. The figure is provided in the standard downhole format with the right side being the lower end 72 of the tool 22 that is run into the wellbore first before the upper end 74 of the tool 22 shown on the left side of the figure. FIG. 3B is an exploded view of a section of the anchor 70 of FIG. 3A so that the features are clearer.

Anchor 70 features a substantially tubular body 76 with a maximum outer diameter 78 and minimum inner diameter 80. At the lower end 72 a coupling mechanism 10 is provided as described herein for connecting the anchor to another downhole component (not shown). The first tubular section 12 is part of an inner mandrel 82 that is connected at the upper end 74 to a J-housing 84 as is known in the art.

At the upper end 74 of the inner mandrel 82, the diameter is tapered to provide a downward facing wedge 86 around the mandrel 82. Slips 88 are arranged around the mandrel 82 and initially held in place using a retaining wire 90 wrapped around the outside of the slips 88. Use of a retaining ring 90 advantageously removes the requirement for mounts for the slips 88 that would increase the wall thickness 79 of the tool 22. The slips 88 abut a spacer ring 92 that can be moved upwards by action of a piston 102 so as to force the slips 88 up the wedge 86 moving them radially outwards to contact an inner surface 94 of the outer tubing 96. Movement of the slips is initially prevented by location of a shear pin 98 in the wedge 86 at the front of the slips 88. This arrangement provides anchoring of the downhole tool 22 to the outer tubing 96.

Figure 4A:
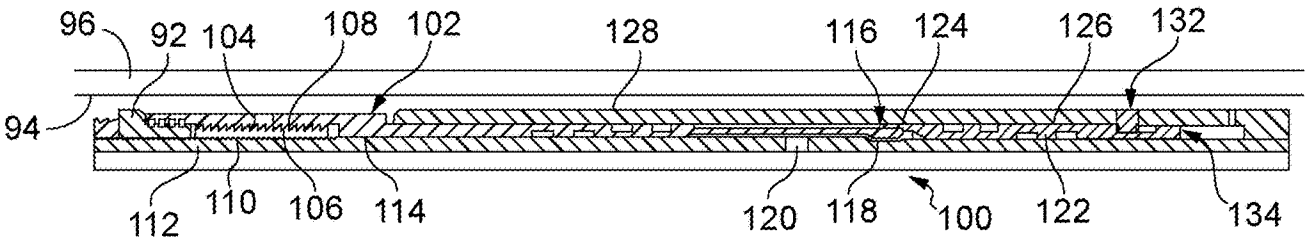
FIGS. 4A and 4B are cross-sectional views of the piston of the anchor of FIG. 3 shown in locked (FIG. 4A) and unlocked (FIG. 4B) configurations.

A piston locking assembly 100 is used to prevent premature actuation of the anchor 70 especially during run-in. The piston locking assembly 100 sits between the spacer ring 92 and the coupling mechanism 10. FIG. 4A shows the piston locking assembly 100 in a run-in configuration.

Piston locking assembly 100 includes the piston 102 being a cylindrical body arranged around the mandrel 82. At the upper end it is connected to the spacer ring 92 via a wire and groove arrangement as per the tensile load arrangement 16 described hereinbefore. Four wires are illustrated but there could be any number. Behind the spacer ring 92 is a locking ring 104 whose outer surface 106 is threaded to attach to an inner surface 108 of the piston 102. The inner surface 110 of the locking ring 104 is also threaded with a complementary left hand thread 112 along the outer surface 114 of the mandrel 82 that extends to the wedge 86. At a lower end of the piston 102 are collet fingers 116 that are directed inwardly and locate in a recess 118 formed on the outer surface 114 of the mandrel 82. Recess 118 is located below a port 120 through the mandrel 82.

Below the piston 102 is a locking element 122. This is a ring having an upwardly directed lip 124 at its upper end, extending the outer surface 126 at the upper end. The locking element 122 also has a circumferential groove 134 around the outer surface 126 towards a lower end. A piston housing 128 slides over the locking element 122 and a portion of the piston 102. The piston housing 128 is fixed to the inner mandrel 82 and/or a second tubular portion 14 at the lower end. The locking element 122 is moveable between the housing 128 and mandrel 82 but is sealed 130 to both and initially held in place via a shear pins 132 through the housing 128 locating in the groove 134. Similarly, the piston 102 is moveable between the housing 128 and mandrel 82 but is sealed 136 to both and initially held in place by virtue of the collet fingers 116 located in the recess 118 and locked in place by the lip 124 of the locking element 122.

In the run-in configuration, shown in FIGS. 3A, 3B and 4A, the slips 88 are held in position at the bottom of the wedge 86 by the retaining wire 90. The spacer ring 92 abuts the slips 88 and is held to the piston 102 with the locking ring 104 sitting adjacent the spacer ring 92 and connecting to the mandrel 82 and piston 102. The collet fingers 116 and in the recess 118. The locking element 122 is positioned so that the lip 124 is over ends of the collet fingers 116 and supports them in the recess 118. The locking element 122 is prevented from moving off the fingers 116 as it is held in place by shear pin 132 located through the housing 128 and locating in the groove 134. In this configuration, the tool 22 can be run in the outer tubing 96, and if it encounters ledges such as at casing collars, it cannot be activated.

Figure 4B:
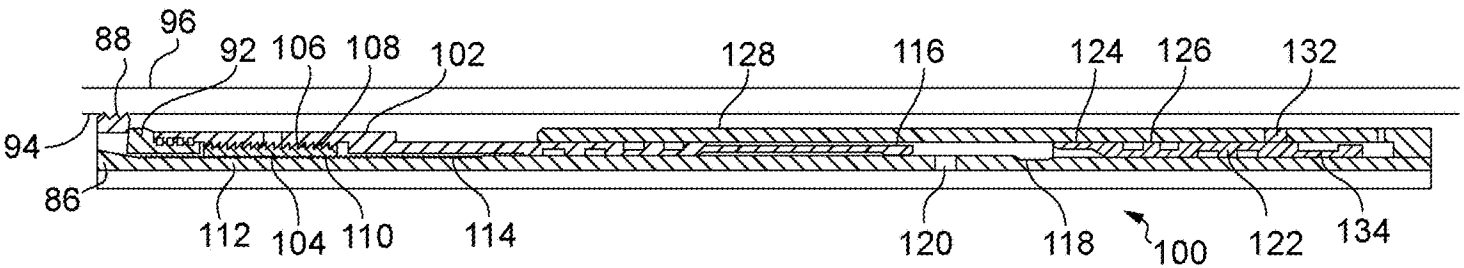

When the anchor 70 requires setting, pressure is applied through the bore 138 from the surface. The pressurized fluid enters the tool 22 through the port 120. The pressure acts on the locking element 122 until the pressure is sufficient to shear the pins 132 allowing the element to move downward until the lip 124 is clear of the collet fingers 116. This releases the collet fingers 116 so that they come out of the recess 118. Fluid pressure now acts on the piston 102 moving it upwards. The piston 102 acts on the locking ring 104, spacer ring 92 and ultimately the slips 88. With sufficient pressure the slips 88 move upwards along the wedge 86 and radially outwards so that they contact and grip the inner surface 94 of the outer tubing 96. On movement the slips 88 will contact and shear the shear pins 98 while breaking the retaining wire 90. Due to the close tolerance between the slips 88 and the outer tubing 96, the slips 88 will never clear the width of the spacer ring 92 and thus will only move upwards and outwards. The anchor set arrangement is illustrated in FIG. 4B. Advantageously, pressure does not have to be held to keep the anchor in the set configuration due to the locking ring 104 arrangement on the mandrel 82 that acts as a ratchet when the piston 102 moves.

The overall outer diameter 78 of the anchor 70 in the run-in configuration is less than or equal to the overall outer diameter 66 of the coupling mechanism 10. Thus, the anchor 70 is suitable for slim hole applications. Additionally, the minimum inner diameter 80 of the anchor 70 is equal to the minimum inner diameter 68 of coupling mechanism 10 by virtue of the inner tubular section 12 of the coupling mechanism 10 being formed on the same mandrel 82 as the anchor 70. Thus, the wall thickness 64, 79 of the anchor 70 and coupling mechanism 10 are substantially the same.

Figure 5:
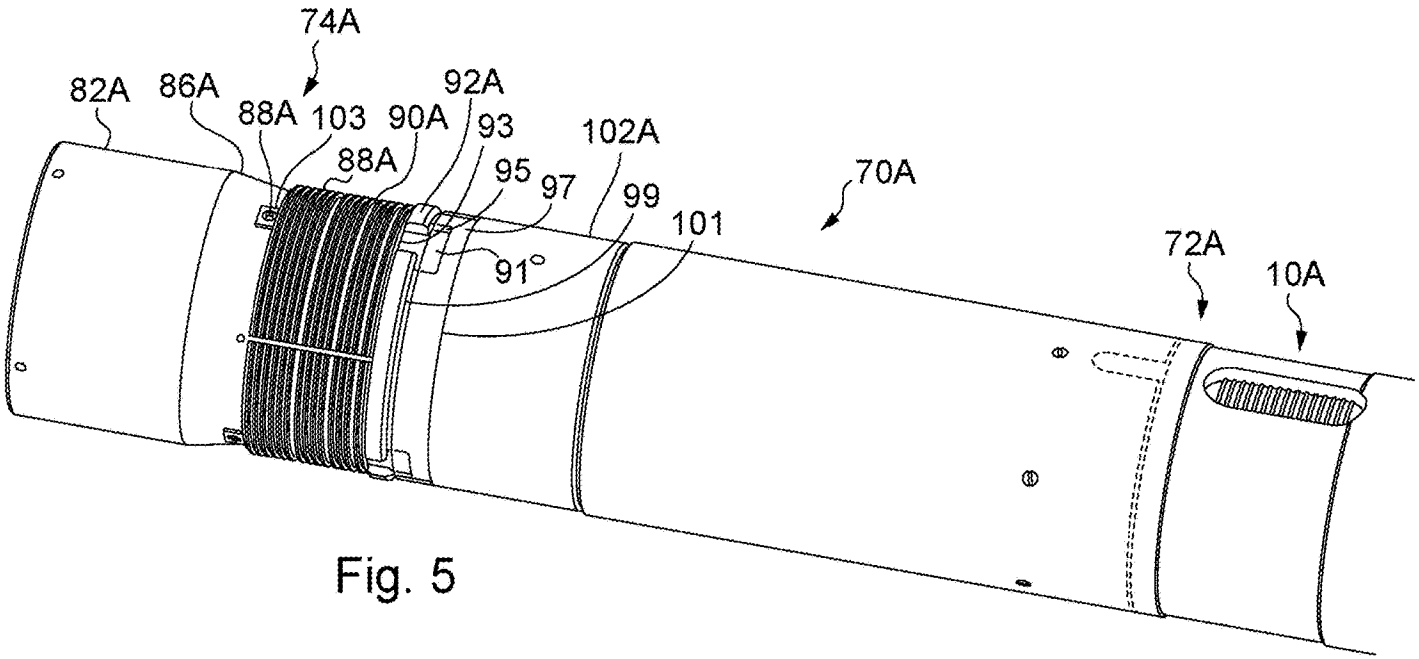
FIG. 5 is a schematic view of an anchor including the coupling mechanism of FIG. 1 according to an alternative embodiment described herein.

FIG. 5 illustrates an alternative embodiment for the slips 88A that provides a mechanical constraint to prevent the slips 88A from unwanted movement until actuation. Those like parts to FIGS. 3 and 4 are given the same reference numbers and suffixed 'A,' for clarity. FIG. 5 shows an anchor 70A where at the lower end 72A there is arranged a coupling mechanism 10A as described herein for connecting the anchor to another downhole component (not shown).

At the upper end 74A of the inner mandrel 82A, the diameter is tapered to provide a downward facing wedge 86A around the mandrel 82A. Slips 88A are arranged around the mandrel 82A and initially held in place using three retaining wires 90A wrapped around the outside of the slips 88A in the same manner as for FIGS. 3 and 4. However, where the slips 88 abutted a spacer ring 92 in the earlier embodiment, the slips 88A now have tabs 91 extending from a lower end 93. Typically, there is a tab 91 on each section of the slip 88A. Spacer ring 92A is extended to provide mating recesses 95 for the tabs 91. The spacer ring 92A is connected to the piston 102A in an identical manner as before with the addition of a securing band 97, between a lower shoulder 99 of the spacer ring 92A and the end face 101 of the piston 102. The securing band 97 (shown in transparency in FIG. 6) of soft metal lies over the interlocking arrangement of tabs 91 and recesses 95 to prevent movement radially outwards when the piston 102 is actuated. Further, the shear pin 88 on the wedge 86 is now a pin or screw 88A, located in a front tab 103 of each slip 88A. This secures the front or nose of the slips 88A to the mandrel 82A to provide added security to the slips and prevent unwanted movement until actuation is desired. Anchor 70A is operated in the same manner as anchor 70.

Figure 6:
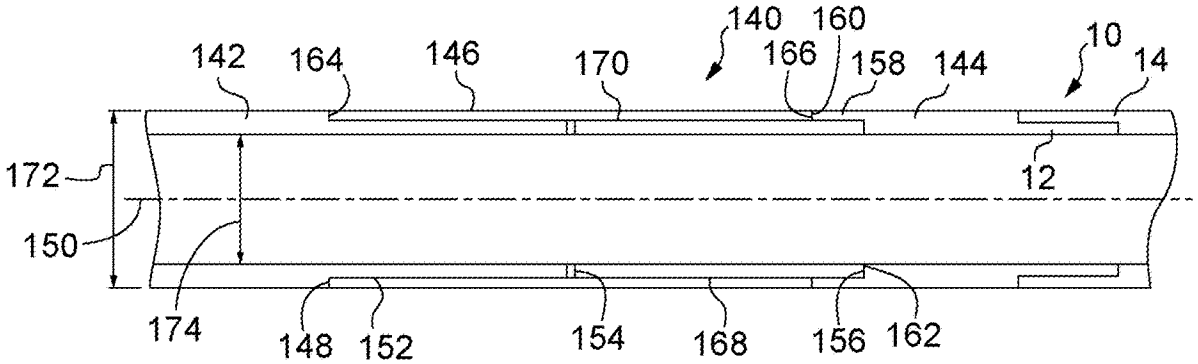
FIG. 6 is a cross-sectional view through a packer suitable for use with the downhole coupling mechanism of FIG. 1.

A further embodiment of a downhole tool 22 that can use the coupling mechanism 10 is a packer 140, as illustrated in FIG. 6. Packer 140 features three tubular parts, a mandrel 142, a bottom section 144, and a sleeve member 146. Each part is machined as a single piece, and the bottom section 144 forms the first tubular section 12 of the coupling mechanism 10. The mandrel 142 provides a downward facing ledge 148 perpendicular to an axis of the central bore 150 on its outer surface 152. There is a port 154 through the mandrel 142. The mandrel 142 has an end face 156 at its lower end that is perpendicular to the axis of the central bore 150. The bottom section 144 is arranged at the lower end of the mandrel with a portion 158 extending over the mandrel 142 and presenting an upward facing end face 160 that is perpendicular to the axis of the central bore 150. The bottom section 144 has an upward facing ledge 162 that is perpendicular to the axis of the central bore 150. The lower end of the bottom section 144 forms the first tubular section 12 of the coupling mechanism 10. A tubular section with first and second end faces 164, 166 respectively forms the sleeve member 146.

The sleeve member 146 is slid over the mandrel 142 in order to abut the ledge 148 with the first end face 164. The ledge 148 and face 164 are joined together. The bottom section 144 is then slid over the end of the mandrel 142 so the portion 158 sits on the mandrel and the end face 160 abuts the second end face 166 of the sleeve member 146. The faces are joined together. This connection also sees the ledge 162 of the bottom section 144 abutting the end face 156 of the mandrel 142. The ledge 162 and face 156 are joined together. The mandrel 142 and bottom section 144 are made of a hardened steel that does not yield under pressure. The sleeve member 146 is made of a ductile metal that yields under pressure. The joints are formed by welding or other suitable techniques known to those skilled in the art to provide a pressure tight seal between the components.

The packer 140 is run into the well in the configuration shown in FIG. 6. At the desired location, fluid pressure is increased from the surface, or via a running tool inside the packer 140, so that fluid under pressure enters the port 154. This fluid reaches a chamber 168 created between the outer surface 152 of the mandrel 142 and the inner surface 170 of the sleeve member 146. The ductile metal of the sleeve member 146 yields and expands. The sleeve member 146 morphs against the inner surface 94 of the outer tubing 96 and creates a metal to metal seal. As the sleeve member 146 undergoes elastic and plastic deformation during morphing, the packer 140 holds a seal between the packer 140 and the outer tubing 96 thereby maintaining a seal across the annulus between both.

The overall outer diameter 172 of the packer 140 in the run-in configuration is less than or equal to the overall outer diameter 66 of the coupling mechanism 10. Thus, the packer 140 is suitable for slim hole applications. Additionally, the minimum inner diameter 174 of the packer 140 is equal to the minimum inner diameter 68 of the coupling mechanism 10 by virtue of the inner tubular section 12 of the coupling mechanism 10 being formed in the same piece as the bottom section 144. Thus, the wall thickness 64, 176 of packer 140 and coupling mechanism 10 are substantially the same.

The anchor 70 may be used along with the packer 140 on a string. Advantageously the anchor 70 may be located above the packer 140 as the anchor 70 does not require holding pressure in use. This is the reverse of typical packers where the slips are used to expand the packer element and thus pressure must be held by the anchor to keep the packer element expanded in use.

The principle advantage of the downhole coupling mechanism described herein is that it provides a coupling mechanism for securing tubular sections together in a wellbore over a thin wall not achievable using a screw-threaded connection and not achievable by the means provided previously. A further advantage of at least one embodiment of the downhole coupling mechanism described herein is that it provides an anchor for securing tubular sections together in a wellbore over a thin wall not achievable previously. A still further advantage of at least one embodiment of the downhole coupling mechanism described herein is that it provides a packer for securing tubular sections together in a wellbore over a thin wall not achievable previously. The downhole coupling mechanism described herein features novel means for attaching a mandrel to a bottom section while maintaining a seal, tensile loading and torque ratings. The downhole coupling mechanism described herein provides wire set in grooves to hold tensile, and then provides for using torque shoulders to handle the torque.

It will be appreciated to those skilled in the art that various modifications may be made to the description herein provided without departing from the scope thereof. For example, the grooves and further grooves in the downhole coupling mechanism may be reversed.

We claim:

1. A downhole coupling mechanism between a first end of a first tubular section being part of a downhole tool and a second end of a second tubular section, comprising:

one or more complimentary circumferential grooves machined in opposing surfaces of each end that align when the first and second ends are arranged co-axially one inside the other;

at least one wire located within one of the circumferential grooves on the first end and a complimentary one of the circumferential grooves on the second end, wherein each pair of complimentary grooves contains the at least one wire extending around the circumference of the surface of each end;

at least one lug and corresponding notch arranged on opposite of the first and second ends providing interlocking engagement when the first and second ends are arranged co-axially one inside the other, wherein the at least one notch extends from an inner surface of the second tubular section and does not extend through the wall thickness of the second tubular member; and one or more seals arranged between the opposing surfaces when the first and second ends are arranged co-axially one inside the other.

2. The downhole coupling mechanism according to claim 1, wherein a wall thickness of the downhole coupling mechanism when the first and second ends are arranged co-axially one inside the other is less than or equal to 10% of an overall outer diameter of the downhole coupling mechanism.

3. The downhole coupling mechanism according to claim 2, wherein the wall thickness of the downhole coupling mechanism when the first and second ends are arranged co-axially one inside the other is less than or equal to 12% of a minimum inner diameter of the downhole coupling mechanism.

4. The downhole coupling mechanism according to claim 1, wherein the one or more seals are each arranged in a seating groove wherein the seating groove is circumferential and continuous around an outer surface.

5. The downhole coupling mechanism according to claim 1, wherein the at least one lug and notch comprises two lugs and notches wherein the two lugs and notches are provided opposite of the first and second ends and arranged equidistant around the opposing surfaces.

6. The downhole coupling mechanism according to claim 5, wherein a length of the lug co-axial with a central axis of the tubular sections is greater than the wall thickness of the downhole coupling mechanism.

7. The downhole coupling mechanism according to claim 1, wherein the one or more complementary grooves comprise a plurality of complimentary circumferential grooves, wherein each complimentary pair of grooves contains a wire.

8. The downhole coupling mechanism according to claim 7, wherein the plurality of complimentary circumferential grooves comprise at least eleven pairs of complimentary circumferential grooves.

9. The downhole coupling mechanism according to claim 1, wherein the at least one wire is a continuous loop of square cross-section, and wherein each of the wires has a cross-section dimension greater than a depth of the circumferential groove on the first end or the depth of the circumferential grooves on the second end.

10. The downhole coupling mechanism according claim 1, wherein the downhole tool is selected from a group comprising: a packer, a liner hanger and an anchor.

11. The downhole coupling mechanism according to claim 10, wherein the downhole tool comprises a morphable element being a sleeve arranged on the tool body, sealed thereto and providing an annular chamber, and wherein when fluid is introduced to the chamber, expands the sleeve to seal against a borehole wall or a tubular wherein the morphable element is located.

12. The downhole coupling mechanism according to claim 11, wherein the piston lock is released and the piston moves at a fluid pressure above a setting pressure for the morphable element.

13. The downhole coupling mechanism according to claim 12, wherein the morphable element is metal and the setting pressure morphs the sleeve against an outer substantially cylindrical structure.

14. The downhole coupling mechanism according to claim 1, wherein the downhole coupling mechanism is provided at a lower end of the downhole tool and is operable to connect the tool to a tubular string located deeper in a well.

15. The downhole coupling mechanism according to claim 1, wherein the downhole tool comprises a plurality of slips arranged on a wedge formed in a body of the tool, wherein the slips are moveable radially outwards by action of a piston moved longitudinal in a first direction, and wherein the slips are held against the body by at least one retainer band prior to movement by the piston.

16. The downhole coupling mechanism according to claim 15, wherein a wall thickness of the downhole tool prior to actuating the slips is less than or equal to 10% of an overall outer diameter of the downhole tool prior to actuating the slips.

17. The downhole coupling mechanism according claim 15, wherein the downhole tool comprises a ratchet arranged to prevent movement of the slips in a second direction, opposite the first direction.

18. The downhole coupling mechanism according to claim 15, wherein the downhole tool includes a piston lock to prevent movement of the piston until actuation of the slips is required.

19. The downhole coupling mechanism according to claim 18, wherein the piston lock comprises a sleeve moveable under pressure to release a collet arranged on the piston.

20. The downhole coupling mechanism according to claim 1, wherein the interlocking engagement prevents rotation of the second tubular section relative to the first tubular section about a central axis of the tubular sections.

21. A downhole coupling mechanism between a first end of a first tubular section being part of a downhole tool and a second end of a second tubular section;

each end including one or more complimentary circumferential grooves machined in opposing surfaces to align when the first and second ends are arranged co-axially one inside the other;

one or more wires, each wire being located within one of the circumferential grooves on the first end and a complimentary one of the circumferential grooves on the second end, so that each pair of complimentary grooves contains one wire extending around the circumference of the surface of each end, wherein the wires are continuous loops of square cross-section, and wherein each of the wires has a dimension in cross-section greater than a depth of the circumferential groove on the first end or the depth of the circumferential grooves on the second end where the wires locate;

at least one lug and notch arranged on opposite of the first and second ends providing interlocking engagement when the first and second ends are arranged co-axially one inside the other; and one or more seals arranged between the opposing surfaces when the first and second ends are arranged co-axially one inside the other.

22. The downhole coupling mechanism according to claim 21, wherein the interlocking engagement prevents rotation of the second tubular section relative to the first tubular section about a central axis of the tubular sections.

* * * * *